US005102299A

United States Patent [19]

Frederick

[11] Patent Number: 5,102,299

[45] Date of Patent: Apr. 7, 1992

[54] AIRFOIL TRAILING EDGE COOLING CONFIGURATION

[75] Inventor: Robert Frederick, Cincinnati, Ohio

[73] Assignee: The United States of America as represented by the Secretary of the Air Force, Washington, D.C.

[21] Appl. No.: 928,348

[22] Filed: Nov. 10, 1986

[51] Int. Cl.[5] ..... F01D 5/18

[52] U.S. Cl. ..... 416/97 R; 415/115

[58] Field of Search ..... 416/97 R, 97 A; 415/115

[56] References Cited

U.S. PATENT DOCUMENTS

| | | | |
|---|---|---|---|
| 3,475,107 | 10/1969 | Anxier | 416/97 X |
| 3,560,107 | 2/1971 | Helms | 416/97 A |
| 3,606,573 | 9/1971 | Emmerson et al. | 416/97 A |
| 3,644,059 | 2/1972 | Bryan | 416/97 A |
| 3,672,787 | 6/1972 | Thorstenson | 416/97 A |
| 3,726,604 | 4/1973 | Helms et al. | 416/97 A X |
| 3,767,322 | 10/1973 | Durgin et al. | 416/97 R |
| 3,819,295 | 6/1974 | Hauser et al. | 416/97 |
| 3,864,058 | 2/1975 | Womack | 416/97 |
| 3,934,322 | 1/1976 | Hauser et al. | 29/156.8 H |
| 4,026,659 | 5/1977 | Freeman | 416/97 R X |
| 4,221,539 | 9/1980 | Corrigan | 416/97 A |
| 4,229,140 | 10/1980 | Scott | 416/97 R |
| 4,297,077 | 10/1981 | Durgin et al. | 416/97 R |
| 4,303,374 | 12/1981 | Braddy | 416/97 R |
| 4,407,632 | 10/1983 | Liang | 416/97 R |
| 4,437,810 | 3/1984 | Pearce | 415/115 |
| 4,485,630 | 12/1984 | Kenworthy | 416/97 R X |
| 4,573,865 | 3/1986 | Hsia et al. | 416/97 R X |
| 4,601,638 | 7/1986 | Hill et al. | 416/97 R |

FOREIGN PATENT DOCUMENTS

| | | | |
|---|---|---|---|
| 113204 | 6/1984 | Japan | 416/97 R |
| 192803 | 10/1985 | Japan | 416/97 R |
| 960071 | 6/1964 | United Kingdom | 416/97 R |
| 1033759 | 6/1966 | United Kingdom | 416/97 R |
| 1299904 | 12/1972 | United Kingdom | 416/97 R |
| 1366704 | 9/1974 | United Kingdom | 416/97 R |

*Primary Examiner*—Everette A. Powell, Jr.
*Attorney, Agent, or Firm*—Robert Nathans; Donald J. Singer

[57] ABSTRACT

An airfoil includes a plurality of interior cooling air paths arranged so as to provide crossover metering and pressure side bleed of cooling air at the trailing edge region of the airfoil.

6 Claims, 1 Drawing Sheet

AIRFOIL TRAILING EDGE COOLING CONFIGURATION

STATEMENT OF GOVERNMENT INTEREST

The invention described herein may be manufactured and used by or for the Government for governmental purposes without the payment of any royalty thereon.

BACKGROUND OF THE INVENTION

This invention concerns an airfoil and more particularly a turbine airfoil whose unique internal construction improves the effectiveness of air cooling at the trailing edge region of the airfoil.

Airfoils constructed with cavities forming passageways for directing cooling fluid therethrough are well known in the art. For example, it is common practice to construct airfoils with spanwise cavities formed within the wider forward portion of the airfoil. These cavities sometimes have inserts disposed therein which define compartments and the like within the cavities. The cooling fluid is brought into the cavities and compartments and some of the fluid is often ejected therefrom via holes in the walls of the airfoil to film cool the external surface of the airfoil.

The trailing edge region of airfoils is generally more difficult to cool than other portions of the airfoil because the cooling air is hot when it arrives at the trailing edge, since it has been used to cool other portions of the airfoil, and the relative thinness of the trailing edge region limits the rate at which cooling fluid can be passed through that region.

A common technique for cooling the trailing edge region is to pass cooling fluid from the larger cavity in the forward portion of the airfoil through the trailing edge region of the airfoil via a plurality of small diameter drilled passageways. Such an airfoil construction is shown in U.S. Pat. No. 4,183,716.

Another common technique for convectively cooling the trailing edge region is by forming a narrow slot between the walls in the trailing edge region, and having the slot communicate with a cavity in the forward portion of the airfoil and with outlet means along the trailing edge of the airfoil. The slot carries the cooling fluid from the cavity to the outlets in the trailing edge. An array of pedestals extending across the slot from the pressure to the suction side wall are typically incorporated to create turbulence in the cooling air flow as it passes through the slot, and to increase the convective cooling surface of the airfoil. The rate of heat transfer is thereby increased, and the rate of cooling fluid flow required to be passed through the trailing edge region may be reduced. U.S. Pat. Nos. 3,628,885 3,819,295, 3,934,322; 3,994,622 4,297,077 and 4,407,632 disclose examples of airfoils constructed in this manner.

Another airfoil constructed with improved means for carrying cooling fluid from a cavity in the forward portion of the airfoil through the trailing edge region and out the trailing edge of the airfoil is shown in U.S. Pat. No. 4,203,706. In that patent, wavy criss-crossing grooves in opposing side walls of the trailing edge region of an airfoil provide tortuous paths for the cooling fluid through the trailing edge region and thereby improve heat transfer rates.

In U.S. Pat. No. 4,437,810 there is disclosed another airfoil having apertures in its trailing edge for cooling air ejection. A metering insert extends between the opposed internal faces of the airfoil adjacent the trailing edge to define the required flow areas.

U.S. Pat. No. 3,864,058 teaches an airfoil having a separate machinable insert within the airfoil and having two separate supply ports for the cooling fluid. One port is in communication with the cooling passage for the suction surface, and the other port communicates with the passages for cooling the pressure surface. The cooling fluid streams are combined and discharged through a slot on the pressure surface of the trailing edge of the airfoil.

The discharge of spent cooling air as a film through high coverage slots on the pressure side wall of the trailing edge of an airfoil, sometimes referred to as pressure side bleed, has become desirable for both structural and manufacturing reasons brought about by the exceedingly thin trailing edges of modern turbine airfoils. A disadvantage of this scheme over conventional air outlets in the trailing edge is its decreased cooling effectiveness, primarily due to a lack of metering capability.

Despite the variety of trailing edge region cooling configurations described in the prior art, further improvement is always desirable in order to function with such thin trailing edge airfoils and allow the use of higher operating temperatures, less exotic materials, and reduced cooling air flow rates through the airfoils, as well as to minimize manufacturing costs.

OBJECTS AND SUMMARY OF THE INVENTION

The primary object of the present invention is therefore to provide an airfoil having a further improved convective cooling configuration in the trailing edge region.

A more specific object of the present invention is to provide an airfoil having a pressure side bleed configuration of enhanced heat transfer capability and reduced manufacturing complexity and cost.

According to the present invention, the trailing edge region of an airfoil has a plurality of cooling air input channels formed in the inner surface of the suction side wall of the airfoil. The cooling air input channels receive cooling air from a cavity which spans the forward region of the airfoil and communicate with narrow finger-like passageways, which in turn pass cooling air to corresponding cooling air output channels formed in the inner surface of the pressure side wall of the airfoil. The cooling air output channels terminate as air discharge slots on the pressure side wall of the airfoil.

Distribution and metering of the cooling air begins as the air enters the input channels and narrow finger-like passageways formed in the inner surface of the suction side wall of the airfoil. The air then turns ninety degrees through the open side of the passageway where it overlays the output channel formed in the inner surface of the pressure side wall of the airfoil. It then impinges on the inner surface of the pressure side wall of the airfoil and turns another ninety degrees to be discharged as film cooling air at the discharge slots formed on the pressure side wall of the airfoil.

By forcing the cooling air to cross over from the suction side wall to the pressure side wall of the airfoil, and make two ninety degree turns in the process, filling of the discharge slots is maximized. In addition, the increased scrubbing action of the air on the inner surfaces of the airfoil walls greatly improves the cooling efficiency at the trailing edge region of the airfoil.

BRIEF DESCRIPTION OF THE DRAWINGS

The foregoing and other objects, advantages and features of the invention will become apparent from the following detailed description of the preferred embodiment of the invention, as illustrated in the accompanying drawings, in which like reference characters refer to the same parts throughout the different views. The drawings are not necessarily to scale, emphasis instead being placed upon illustrating the principles of the invention.

DESCRIPTION OF THE PREFERRED EMBODIMENT

Figure 1:
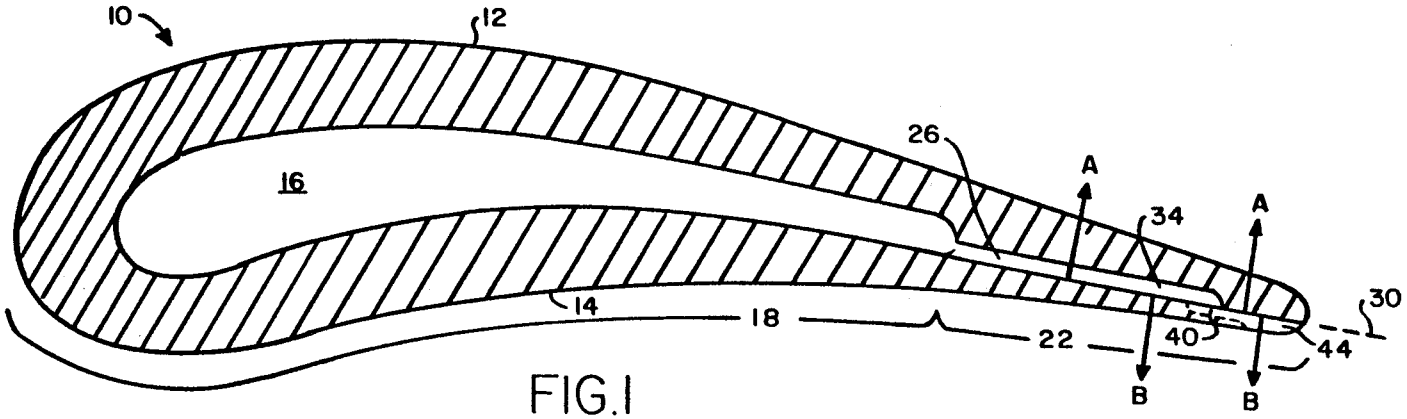
FIG. 1 is a cross-sectional view of an airfoil incorporating the features of the present invention.

As an exemplary embodiment of the present invention, consider the hollow airfoil generally represented by the numeral 10 in FIG. 1. The airfoil 10 has a suction side wall 12 and a pressure side wall 14. The pressure and suction side walls are spaced apart to define a spanwise cooling air cavity 16 in the forward portion 18 of the airfoil.

Since the embodiment is concerned with the cooling configuration in the trailing edge region 22, the configuration of the forward region 18 of the airfoil is not critical except to the extent that it must have a cooling air cavity therein in communication with a plurality of cooling air input channels 26 formed on the inner surface of the suction side wall 12 of the airfoil. In this application the term "cavity" is used in its broadest sense to encompass any cooling air passageway, compartment, or the like, through the forward region 18 which is in communication with channels 26.

For purposes of simplicity, the airfoil 10 of the drawing is shown to be completely hollow in the forward region 18, with no inserts being disposed within the cavity 16. Also, although none are shown, there may be passages through the side walls 12 and 14 over the span of the airfoil to provide film cooling over the outer surfaces of the airfoil, as is well known to those skilled in the art. The airfoil of the foregoing embodiment may be cast as a single piece but is preferrably formed of two pieces which are bonded to each other, such as at the interface line 30 in the trailing edge region 22.

As will become apparent from the other views of the drawings, each cooling air input channel 26 provides a path for air flow from cavity 16 to a narrower passageway 34, thence to an output channel 40, and finally to an air discharge slot 44.

Figure 2:
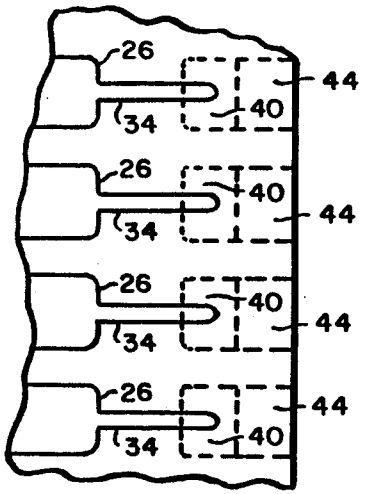
FIG. 2 is a fragmentary view of the trailing edge region of the airfoil as observed along the lines A—A of FIG. 1.

FIG. 2 is a fragmentary view of the inner wall of the suction side wall 12 of airfoil 10, as observed at the interface line 30 in the direction of the lines A—A. In this view each of the cooling air input channels 26 is seen to be of substantially rectangular shape and has a narrow finger-like passageway 34 extending from the end thereof nearest the trailing edge of the airfoil. The dashed lines shown in FIG. 2 indicate the relative locations of the cooling air output channels 40 and air discharge slots 44 which are formed in the pressure side wall 14 of airfoil 10, and make it clear how the ends of the passageways 34 register above and communicate with the output channels 40 on pressure side wall 14.

Figure 3:
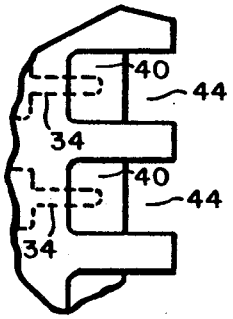
FIG. 3 is a fragmentary view of the trailing edge region of the airfoil as observed along the lines B—B in FIG. 1.

FIG. 3 is a fragmentary view of the inner wall of the pressure side wall 14 of airfoil 10, as observed at the interface line 30 in the direction of the lines B—B. The output channels 40 will be seen to also be substantially rectangular in shape and terminate at exit slots 44 for emitting a film of cooling air on the pressure side wall 14 of airfoil 10. The dashed lines in FIG. 3 represent the location of the air passageways 34 when the suction side wall 12 of airfoil 10 is registered above the pressure side wall 14. It will be seen that each air passageway 34 symmetrically overlies the width of its corresponding output channel 40.

Figure 4:
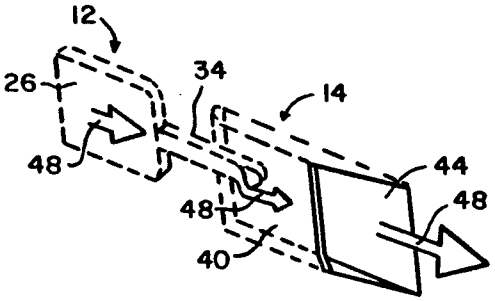
FIG. 4 is a perspective view illustrating the cooling air path through the trailing edge region of the airfoil of the present invention.

FIG. 4 is a perspective view illustrating the path of the cooling air flow through the trailing edge region of airfoil 10. The arrows 48 depict the path taken by the cooling air as it enters the cooling air input channel 26 formed in the suction side wall 12, flows through the narrow passageway 34 also formed in suction side wall 12, takes a ninety degree turn to enter cooling air output channel 40 formed in the pressure side wall 14, takes another ninety degree turn within output channel 40, and exits through the cooling air discharge slot 44 on the pressure side wall 14 of airfoil 10. As previously mentioned, the scrubbing action provided by the cooling air as it follows this tortuous crossover path through the trailing edge region 22 maximizes the filling of the discharge slots 44 and improves the cooling of the trailing edge region 22.

It has been previously mentioned that the airfoil 10 can be cast as a single piece or formed of bonded pieces. If it is formed of a single piece, the cooling air input channel 26 and passageway 34 in the suction side wall 12 would be formed by the core of the casting and the cooling air output channels 40 would be machined later. If the airfoil is formed of two or more pieces, the channel configurations would be machined in both surfaces before they are bonded together.

In addition to the improved heat transfer capability provided by the airfoil of the present invention compared to other pressure side bleed airfoil configurations, it is also easier to machine and therefore provides a manufacturing cost benefit over such prior art.

Although the invention has been described with reference to a particular embodiment thereof, numerous adaptations and modifications of the invention will be apparent to those of skill in the art and hence it is intended by the appended claims to cover all such modifications and adaptions as fall within the true spirit and scope of this invention.

What is claimed is:

1. An airfoil having a pressure side wall and a suction side wall defining a forward region and a trailing edge region of said airfoil;

said pressure side wall abutting said suction side wall in said trailing edge region of said airfoil;

a cavity for receiving cooling air formed between the inner surfaces of said pressure side wall and said suction side wall in said forward region of said airfoil;

a plurality of cooling air discharge slots formed in said pressure side wall in said trailing edge region of said airfoil; and air flow metering and crossover means in said trailing edge region of said airfoil for passing cooling air from said cavity to said cooling air discharge slots;

said air flow metering and crossover means comprising a plurality of cooling air input channels each formed in the inner surface of said suction side wall and entering said cavity, a plurality of cooling air output channels each formed in the inner surface of said pressure side wall and coupled to one of said plurality of cooling air discharge slots, and a plurality of air passageways each formed in the inner surface of said suction side of said airfoil and coupling one of said plurality of cooling air input channels to a corresponding one of said plurality of cooling air output channels.

2. An airfoil as defined in claim 1 wherein each of said plurality of cooling air input channels and each of said plurality of cooling air output channels are of substantially the same width.

3. An airfoil as defined in claim 2 wherein each of said plurality of air passageways has a width of less than one half the width of one of said plurality of cooling air input channels.

4. An airfoil as defined in claim 3 wherein each of said plurality of cooling air input channels, air passageways and cooling air output channels are of substantially rectangular cross section.

5. An airfoil as defined in claim 4 wherein each of said plurality of air passageways symmetrically overlies the width of the corresponding one of said plurality of cooling air output channels.

6. An airfoil as defined in claim 5 wherein said pressure side wall and said suction side wall are separate pieces, said inner surface of said pressure side wall and said inner surface of said suction side wall being bonded together at said trailing edge region.

* * * * *